United States Patent [19]

Mori

[11] 4,081,668

[45] Mar. 28, 1978

[54] SOCKET-MOUNTING APPARATUS FOR LIGHTING DEVICES

[75] Inventor: Shinjiro Mori, Tokyo, Japan

[73] Assignee: Mori Denki Manufacturing Co., Ltd., Tokyo, Japan

[21] Appl. No.: 719,387

[22] Filed: Aug. 31, 1976

[30] Foreign Application Priority Data

Mar. 26, 1976 Japan ..... 51/37188[U]

[51] Int. Cl.[2] ..... F21V 19/02

[52] U.S. Cl. ..... 362/296; 362/376; 362/457

[58] Field of Search ..... 240/44, 44.2, 44.25, 240/44.26, 44.27, 153

[56] References Cited

U.S. PATENT DOCUMENTS

| | | | |
|---|---|---|---|
| 1,291,825 | 1/1919 | Gargan | 240/44.2 |
| 3,694,649 | 9/1972 | Thompson | 240/153 |
| 3,882,307 | 5/1975 | Rambusch et al. | 240/44.2 |

FOREIGN PATENT DOCUMENTS

| | | | |
|---|---|---|---|
| 532,205 | 1/1941 | United Kingdom | 240/44.2 |

*Primary Examiner*—L. T. Hix
*Assistant Examiner*—Alan Mathews
*Attorney, Agent, or Firm*—Wenderoth, Lind & Ponack

[57] ABSTRACT

A socket-mounting apparatus for lighting devices comprising a plurality of socket-fixing clamps and a socket-fixing plate. The clamps are furnished with mounting members for socket fixing at one end and a plurality of mounting legs of different heights, each having a small screw at the other end. At each of the projections, the number of which is the same as that of the clamps provided at the socket-fixing plate's peripheral edge, is formed U-cuts cut from the direction that vertically intersects the axis direction of a lighting body. By shifting the socket-mounting location to the direction parallel to that of the lighting body's axis, the above-structured apparatus enables one to light electric bulbs of different sizes in one lighting body.

3 Claims, 5 Drawing Figures

SOCKET-MOUNTING APPARATUS FOR LIGHTING DEVICES

BACKGROUND OF THE INVENTION

1. Field of the Invention

This invention relates to a socket-mounting apparatus for lighting devices. The mounting location of the socket to be mounted inside of a lighting body is decided according to the generating power of the electric bulb that lights within the body so that the best lighting effect is gained. Especially for those lighting devices which aim to increase the lighting effect by providing a reflecting plate in the lighting body, it is not possible to gain the best lighting effect unless the locations of the socket and the reflecting plate are carefully chosen so as to match the size of the electric bulb.

2. Brief Description of the Prior Art

Since the sizes of mercury-vapor lamps with a 150-watt electric bulb or with a 400-watt electric bulb are completely different, the sizes of the lighting bodies which light those lamps as well as their socket-mounting locations are ordinarily different. Up to the present time, the sizes of the lighting bodies have been decided according to the size of each electric bulb that lights in them, and a lighting device has not yet been proposed which can employ electric bulbs with different generating powers.

SUMMARY OF THE INVENTION

Accordingly, it is an object of the present invention to provide a socket-mounting apparatus which can change the socket-mounting location to the direction parallel to the axis of the lighting body, and also which can light electric bulbs with different generating powers in one lighting body.

DESCRIPTION OF THE PREFERRED EMBODIMENTS

Figure 1:
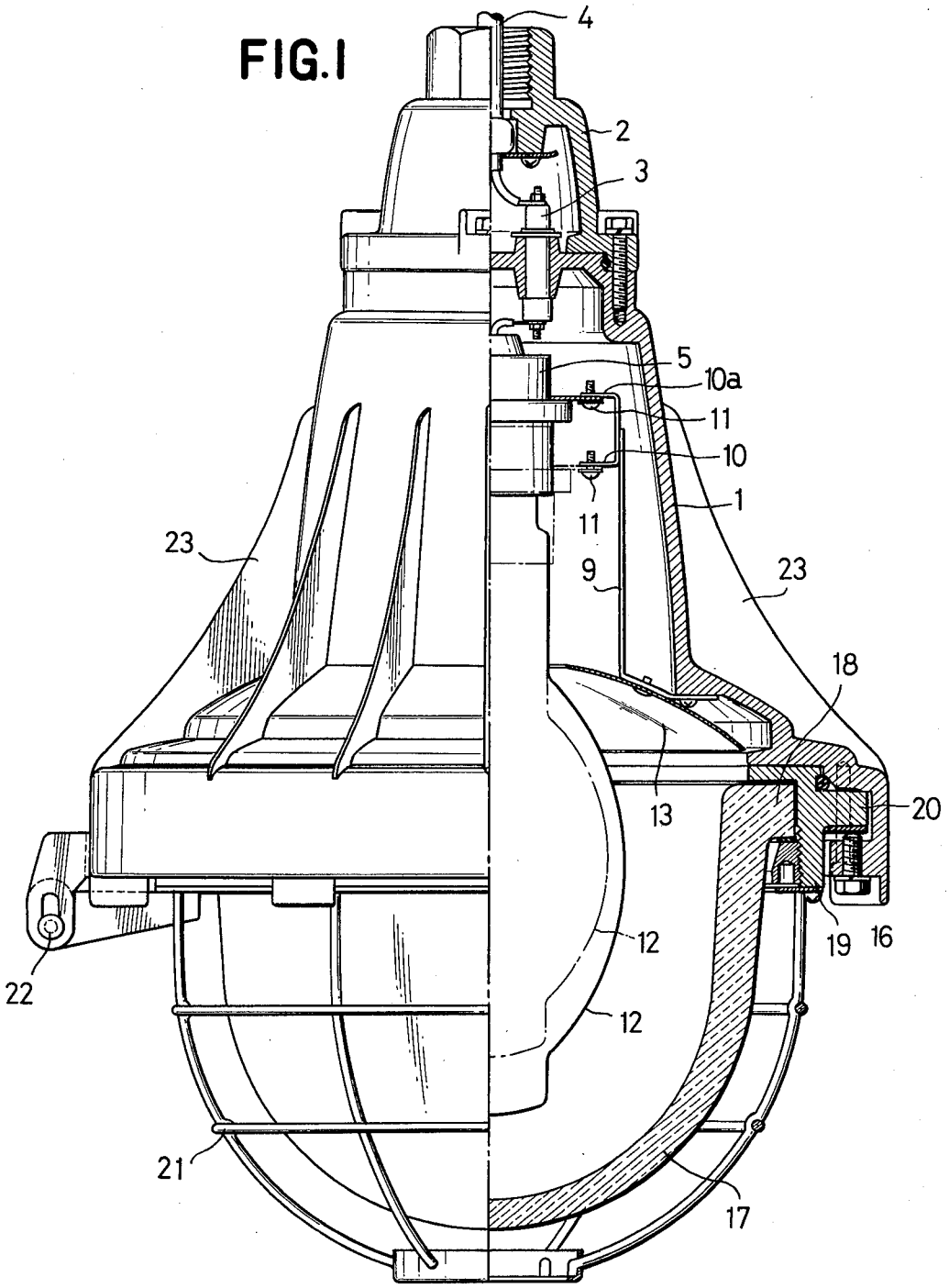
FIG. 1 is a sectional view of the whole apparatus cut vertically apart, showing the condition in which the apparatus may be used for explosion-proof lighting devices.

The details of the present invention are explained below according to the exemplary embodiment of the invention as shown in the drawing. In this exemplary embodiment and figures, only the case in which explosion-proof lighting devices are employed is illustrated, however, the invention can also be used for ordinary (non-explosion-proof) lighting devices.

Turning to the drawings, reference numeral 1 in FIG. 1 represents a lighting body whose one end is open-ended in a circular form; while a socket cover 2 is mounted to the top of the other end. An insulator 3 furnished inside with a copper rod is mounted to the bottom wall of the lighting body in such a manner that it penetrates through the wall. One end of an electric wire 4 guided into the socket cover 2 is connected to the copper rod in the insulator 3, and the part of the rod which protrudes out into the lighting body is connected to the electric wire of a socket 5 which is inside of the body. There is a female screw grooved at the top of the socket cover 2, and the lighting body is mounted to the ceiling or the pillar, etc., by connecting a pipe (not shown in the figures) to this screw and fixing the other end of the pipe to the ceiling or the pillar.

Figure 5:
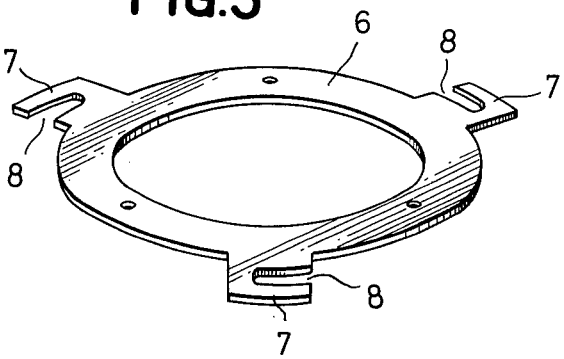
FIG. 5 is a perspective view of a socket-fixing plate.

The socket 5 is made of porcelain and a circular socket-fixing plate 6 (see FIG. 5) is mounted to its body. Three projections 7 (shown in FIG. 5) are provided along the circumference of the socket-fixing plate 6 to each of which, in turn, are provided U-shaped cuts 8 (also shown in FIG. 5) cut from the direction that vertically intersects the direction of the socket's axis. The U-cuts are open to a uniform direction.

Reference numeral 9 indicates socket-fixing clamps at one of whose ends forms a mounting member **9*a* for fixing itself onto the inner wall of the lighting body. Next to this mounting member is formed a reflecting plate-mounting member 9*b* to whose edge, in turn, are provided mounting legs 10 and 10*a* of different heights in the direction opposite to said mounting member 9*a*. Altogether three socket-fixing clamps are employed to fix mounting members 9*a* on the wall of the lighting body in such a manner that all mounting legs 10 and 10*a* are located inside of the body. Also, small screws designated 11 are screwed into mounting legs 10 and 10*a*** at such places where mounting locations do not coincide in plan view. It is convenient, in mounting a socket, for the edges of the screws to be spread out so that they do not fall off when they become loose.

Thus, the socket-fixing plate 6 is mounted to the socket 5 to which, in turn, is mounted a mercury-vapor lamp 12 (shown in FIG. 1). The socket then is inserted to the opening of the lighting body. In case the mercury-vapor lamp 12 is large, the socket 5 is fixed by fixing the socket-fixing plate 6 and the mounting legs **10*a*. In order to do this, the small screws 11 of the mounting legs 10*a* which are behind the opening, are tightened by placing them in the U-shaped cuts 8 provided at the projections 7 of the socket-fixing plate 6**.

In FIG. 1, the condition of an electric bulb and a socket of a 400-watt mercury-vapor lamp which has a larger size is illustrated by the solid line, where as that of a 150-watt lamp is shown by the dotted line.

To mount the socket 5 mounted in the above manner to the mounting legs 10 and **10*a* of the socket-fixing clamps 9 which are located at the front viewed from the opening, the small screws 11 are disengaged from the projections 7 by loosening the screws and turning them counter-clockwise viewed from the bottom. Then, after taking out the socket and changing the electric bulbs, the projections 7 receive the small screws 11 of the mounting legs 10*a*** in the front. This is done by tightening and fixing the small screws after making certain that the socket is turned clockwise and that the screws are fully inserted to the rear of the cuts.

The socket-fixing clamps 9 after being fixed to the lighting body 1, in turn, fix a reflecting plate 13 to the reflecting plate-mounting members **9*b***.

Figure 2:
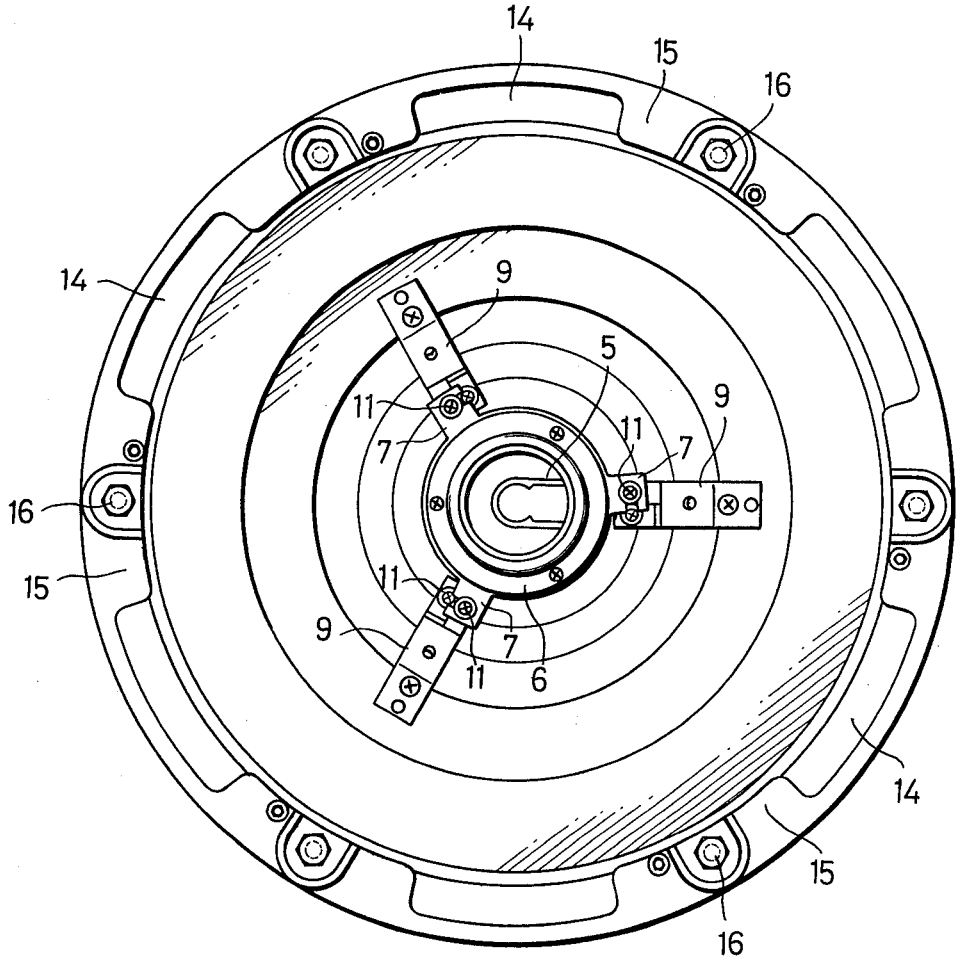
FIG. 2 is a bottom view of the lighting body alone, that is, what is left after globe members are removed from the explosion-proof lighting device shown in FIG. 1.
Figure 3:
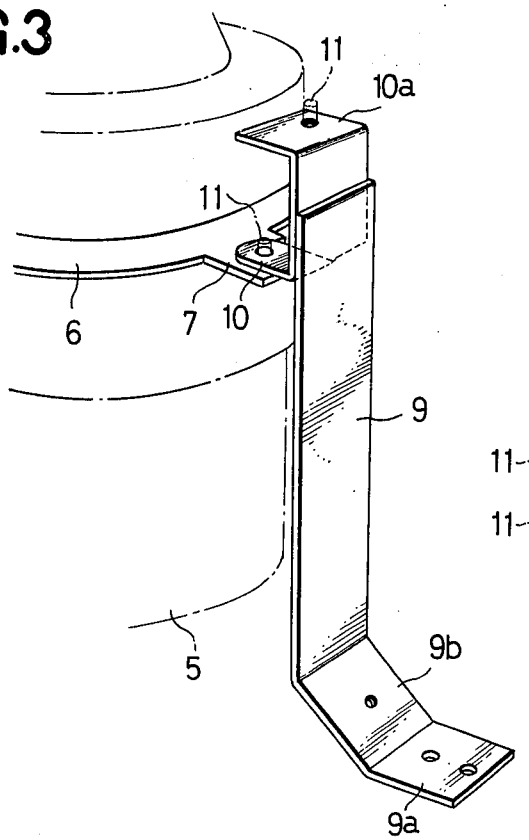
FIG. 3 is a perspective illustration of a socket-fixing clamp.
Figure 4:
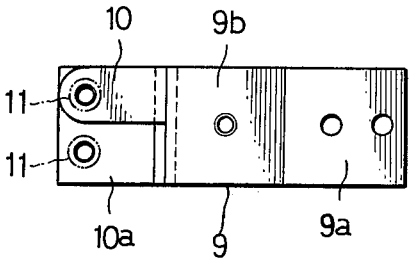
FIG. 4 is a plan view of the above-mentioned clamp.

In one embodiment wherein an explosion-proof lighting device is employed, globe members are provided at the opening of the lighting body 1 in FIG. 1. At the circular body formed at the opening of the lighting body, in turn, are formed cuts 14 and projections 15 alternately, as shown in detail in FIG. 2. To the projections 15 are screwed fastening bolts 16. Reference numeral 17 designates a globe which forms the same number of clamps 20 as that of cuts 14. The cuts 14 are formed at the opening of the above-mentioned lighting body, outside of a globe holder 19 which is furnished with a flange part 18 formed around the periphery of the opening.

The lighting body and the globe holder are fixed to each other by inserting clamps 20 of the holder into the inside of the lighting body through the cuts 14 at the opening of the body 1. Then, clamps 20 are joined with projections 15 by rotating the globe holder about 30° and finally by screwing fastening bolts 16.

Reference numeral 21 indicates a guard for the globe 17 which is mounted to the globe holder 19. Reference numeral 22 indicates a hinge which connects the lighting body 1 and the globe holder 19. When the globe is open at the time of electric bulb replacement, the hinge is connected to the lighting body. Reference numeral 23 indicates a radiating rib formed in the direction of axis at the outer wall of the periphery of the lighting body.

Thus, this invention relates to a socket-mounting apparatus which can change the mounting places of the socket according to the size of the electric bulb to be employed. This means one can employ different kinds of electric bulbs in one lighting body resulting in maximum lighting effects.

What is claimed is:

1. A socket mounting apparatus for lighting devices comprising a plurality of socket-fixing clamps and a socket-fixing plate which has a circular opening in the center thereof such that a light bulb socket may be inserted into said opening, each of said socket-fixing clamps having located at one end thereof a mounting member to affix the clamps to a lighting device and at the other end a plurality of mounting legs which project at right angles to the direction of the clamp and which are spaced apart from each other at different heights along the length of the clamp and wherein each of the mounting legs is provided with a small screw; said socket-fixing plate containing projections extending from the periphery thereof in a number corresponding to the total number of socket-fixing clamps, said projections each containing U-cuts which are formed at right angles in respect to the length of the projections, said mounting legs being affixed to the socket-fixing plate by engaging the small screws located in the mounting legs with the U-cut openings, each of said socket-fixing clamps further containing a reflecting plate-mounting member located between the mounting members and the mounting legs thereof and a reflecting plate mounted onto said reflecting plate-mounting member and wherein the socket-mounting apparatus is such as to permit a lighting device in which it is mounted to accommodate the structure of different size light bulbs by affixing the socket-fixing plates at different heights along the socket-fixing clamps by means of the various mounting legs.

2. A socket-mounting apparatus for lighting devices according to claim 1, in which the number of socket-fixing clamps are three; each clamp contains two mounting legs at one end thereof and wherein the socket-fixing plate contains three projections equally spaced along the periphery thereof.

3. A socket-mounting apparatus for lighting devices according to claim 1, wherein the small screws provided on the mounting legs of said socket-fixing plate are located in such positions that they are not aligned one above the other on the mounting legs so as to be easily accessible for loosening or tightening from the bottom thereof.

* * * * *